US006536506B2

(12) United States Patent
Nikolovski

(10) Patent No.: US 6,536,506 B2
(45) Date of Patent: Mar. 25, 2003

(54) STRIP CASTING

(75) Inventor: Nikolco Nikolovski, Figtree (AU)

(73) Assignee: Castrip LLC, Charlotte, NC (US)

( * ) Notice: Subject to any disclaimer, the term of this patent is extended or adjusted under 35 U.S.C. 154(b) by 0 days.

(21) Appl. No.: 09/882,660

(22) Filed: Jun. 15, 2001

(65) Prior Publication Data

US 2001/0052408 A1 Dec. 20, 2001

(30) Foreign Application Priority Data

Jun. 15, 2000 (AU) ..... PQ8180

(51) Int. Cl.[7] ..... B22D 11/06
(52) U.S. Cl. ..... 164/480; 164/452; 164/428
(58) Field of Search ..... 164/428, 480, 164/452, 154.2

(56) References Cited

U.S. PATENT DOCUMENTS

| | | | | | |
|---|---|---|---|---|---|
| 2,796,781 | A | * | 6/1957 | Mills | 72/246 |
| 4,567,933 | A | | 2/1986 | Lauener et al. | |
| 4,649,986 | A | | 3/1987 | Frischknecht et al. | |
| 4,702,300 | A | * | 10/1987 | Nakanori et al. | 164/428 |
| 4,784,209 | A | | 11/1988 | Hlinka et al. | |
| 5,706,882 | A | * | 1/1998 | Fellus et al. | 164/480 |
| 6,164,366 | A | * | 12/2000 | Fish et al. | 164/480 |
| 6,167,942 | B1 | * | 1/2001 | Fish et al. | 164/480 |
| 6,167,943 | B1 | * | 1/2001 | Fish et al. | 164/480 |

FOREIGN PATENT DOCUMENTS

| | | | | |
|---|---|---|---|---|
| AU | 737788 | * | 4/1999 | 164/480 |
| AU | 85185/98 | | 4/1999 | |
| EP | 1025931 | | 2/2000 | |
| EP | 1025931 | * | 8/2000 | 164/480 |
| JP | 59-193740 | | 11/1984 | |
| JP | 60-083746 | | 5/1985 | |
| JP | 62-6740 | * | 1/1987 | 164/480 |
| JP | 04-017958 | | 1/1992 | |
| JP | 10-305352 | | 11/1998 | |
| WO | WO94/26443 | | 11/1994 | |
| WO | WO99/33595 | | 7/1999 | |

* cited by examiner

*Primary Examiner*—Kuang Y. Lin
(74) *Attorney, Agent, or Firm*—Barnes & Thornburg

(57) ABSTRACT

Twin roll caster for casting thin steel strip comprises chilled casting rolls 16 mounted on roll supports 104. One of the rolls is fixed and the other is moveable laterally and biased toward the other roll by biasing units 119 acting on the moveable roll supports 104. A casting pool of molten steel is supported on the rolls 16 and the rolls are rotated to produce a solidified steel strip delivered downwardly from the nip between the rolls. A substantially constant gap is maintained between rolls 16 such that unsolidifed molten metal passes through the nip between the solidified shells of the forming strip and solidifies below the nip. The biasing units 119 are effective to apply substantially constant and low biasing forces to the biased roll. The biasing forces may be between the same and slightly more than the force required to balance the hydrostatic pressure of the casting pool and to overcome the mechanical friction involved in moving the biased roll. Controlling these casting roll separation forces enables gauge variation in the strip to be reduced.

15 Claims, 8 Drawing Sheets

STRIP CASTING

This application claims priority to and the benefit of Australian Provisional Application Number PQ8180, which was filed in Australia on Jun. 15, 2000.

TECHNICAL FIELD

This invention relates to the casting of metal strip and making of cast steel strip. It has particular application to the casting of metal strip by continuous casting in a twin roll caster.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to form a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

The setting up and adjustment of the casting rolls in a twin roll caster is a significant problem. The casting rolls must be accurately set to properly define an appropriate separation of the casting rolls at the nip, generally of the order of a few millimeters or less, There must also be some means for allowing at least one of the rolls to move outwardly against a biasing force to accommodate fluctuations in strip thickness particularly during start up.

Usually, one of the rolls is mounted in fixed journals, and the other roll in rotatably mounted on supports that can move against the action of biasing means to enable the roll to move laterally to accommodate fluctuations in casting roll separation and strip thickness. The biasing means may be in the form of helical compression springs or alternatively, may comprise a pair of pressure fluid cylinder units.

A strip caster with spring biasing of the laterally moveable roll is disclosed in Australian Patent Application 85185/98 and corresponding U.S. application Ser. No. 09/154213. In that apparatus, the biasing springs act between the roll supports and a pair of thrust reaction structures, the positions of which can be set by operation of a pair of powered mechanical jacks to enable the initial compression of the springs to be adjusted to set initial compression forces which are equal at both ends of the roll. The positions of the roll supports need to be set and subsequently adjusted after commencement of casting so that the gap between the rolls is constant across the width of the nip in order to produce a strip of constant profile. However, as casting continues the profile of the strip will inevitably vary due to eccentricities in the rolls and dynamic changes due to variable heat expansion and other dynamic effects.

Eccentricities in the casting rolls can lead to strip thickness variations along the strip. Such eccentricities can arise either due to machining and assembly of the rolls or due to distortion when the rolls are hot possibly due to non-uniform heat flux distribution. Specifically, each revolution of the casting rolls will produce a pattern of thickness variations dependent on eccentricities in the rolls and this pattern will be repeated for each revolution of the casting rolls. Usually the repeating pattern will be generally sinusoidal, but there may be secondary or subsidiary fluctuations within the generally sinusoidal pattern.

With improvements in the design of the casting rolls for a twin roll caster, particularly by the provision of textured surfaces which enable control of the heat flux at the interface between the casting rolls and the casting pool, it has been possible to achieve dramatic increases in strip casting speeds. However, when casting thin strip at high casting speeds there is an increased tendency to produce both high and low frequency gauge variations.

DISCLOSURE OF THE INVENTION

We have found that the gauge variations in cast strip can be alleviated by reducing the casting roll separation force and that the defect can be practically eliminated if the roll separation force in minimized. In practice there is at least a certain force that is required to balance the hydrostatic pool pressure and to overcome the mechanical friction involved in moving the rolls. We have also found that the high frequency gauge variation can be overcome, and a unique cast steel strip can be produced, by reducing the strip stiffness in the region of the nip by allowing a quantity of mushy or molten metal to be passed through the nip between the two solidified shells of the strip, by maintaining a roll gap at the nip slightly greater than the gap determined by the fully solidified shell thickness. It is desirable for these purposes that the mechanical friction forces involved in movement of the casting rolls relative to each other is minimized. By achieving very low strip stiffness, the dynamic interaction of the rolls on the strip is uncoupled, and consequently periodic gauge variation regeneration can be substantially reduced if not eliminated.

In at least one aspect, the present invention combines the features of applying a constant casting roll separation force (which can be small) and establishing a constant roll gap that will enable molten metal to be passed through the nip to further reduce strip stiffness. In order to maintain the constant separation force together with a constant roll gap, the invention may also allow for roll eccentricity compensation.

According to the invention there is provided a method of casting metal strip including introducing molten metal between a pair of chilled casting rolls forming a nip between them to form a casting pool of molten metal supported on the rolls, confining the pool at the ends of the nip by pool confining closures and rotating the rolls such that shells of metal solidify from the casting pool onto the casting rolls and are brought close together at the nip to produce a solidified strip delivered downwardly from the nip The casting rolls are biased bodily toward each other, in at least some embodiments under a substantially constant biasing force, and are maintained with a substantially constant gap between them at the nip. This gap is such as to maintain separation between the solidified shells at the nip so that molten metal passes in the space between them through the nip and is, at least in part, subsequently solidified between the solidified shells within the strip below the nip.

The molten metal may be molten steel and the method may produce solidified steel strip at a casting speed of at least 30 meters/minute. The casting speed may be at least 60 meters/minute. The separation space between the solidified shells at the nip may be in the range 0 to 50 microns. This separation provides for maintaining a substantially constant gap with a small biasing force Said biasing force may be substantially equal to or slightly more than the minimum force required to balance the hydrostatic pressure of the casting pool and to overcome the mechanical friction involved in moving the biased roll. For 500 mm rolls 1350 mm wide and 175 mm pool, putting aside mechanical friction that should be kept small, the hydrostatic force of the molten casting pool will be about 0.75 kN. The biasing force, therefore, may be in range 0.75 to 2 kN per chuck (i.e., per side), and the corresponding roll separation force in the range of substantially 0 to 1.25 kN. Roll separation force is the net force exerted on the strip.

The roll biasing force may be in the range of 0.75 to 1.2 kN and the corresponding roll separation force substantially 0 to less than 0.45 kN. For strip thicknesses above 1 mm the roll separation force may be less than 0.45 kN. By way of example for 1.6 mm thick strip the roll separation force is about 0.45 kN.

At least one casting roll may be mounted on a pair of moveable roll supports moveable to provide said bodily movement of at least one of the casting rolls relative to the other casting roll, and said biasing force may be applied to the roll supports by a pair of biasing units. Each biasing unit may includes a thrust generator acting between a thrust transmission structure connected to the respective roll support, and a thrust reaction structure generating a thrust on the roll support dependent on the spacing between the thrust reaction structure and the thrust transmission structure. The thrust generator may comprise a compression spring or pressure fluid cylinder unit.

The described method may then include the steps of initiating casting of the strip with a gap between the rolls determined by having the solidified shells to meet at the nip, allowing said one roll to move bodily to follow strip thickness variation due to casting roll eccentricities to establish a pattern of roll movements due to those eccentricities, applying the same pattern of movement to the thrust reaction structures of the biasing units to maintain a constant biasing force, increasing the gap between the casting rolls such that molten metal passes through the nip between the solidified shells, and continuing casting of the strip with the increased gap held substantially constant and applying said pattern of movement to the thrust reaction structures to maintain a substantially constant roll biasing force.

Further provided is apparatus for continuously casting metal strip comprising a pair of parallel casting rolls forming a nip between them; metal delivery means to deliver molten metal into the nip between the rolls to form a casting pool of molten metal supported on casting roll surfaces immediately above the nip; pool confining means to confine the molten metal in the casting pool against outflow from the ends of the nip; and roll drive to drive the casting rolls in the counter-rotational directions to produce a solidified strip of metal delivered downwardly from the nip; wherein at least one of the casting rolls is mounted on a pair of moveable roll carriers which allow that one roll to move bodily toward and away from the other roll, wherein there is a pair of roll biasing units acting one on each of the pair of moveable roll carriers to bias said one roll bodily toward the other roll, and wherein each roll biasing unit comprises a thrust transmission structure connected to the respective roll carrier, a thrust reaction structure, a thrust generator acting between the thrust reaction structure and the thrust transmission structure to exert a thrust on the thrust transmission structure and the respective roll carrier, thrust reaction structure setting means operable to vary the position of the thrust reaction structure, and control means to control operation of the setting means so as to replicate a pattern of movement of the roll supports due to roll eccentricities as an applied pattern of movements of the thrust reaction structure to maintain a constant roll biasing force, and roll gap control means operable to increase the gap between the rolls after said applied pattern of movements has been established.

The roll gap control means may be operable to produce an incremental increase of the roll gap in the range 0 to 50 microns. The roll gap control means may be operable to move said one roll. Alternatively, it may be operable to move the other casting roll. In other embodiments, to provide small roll separation force, the roll gap may be fixed and the casting speed may be varied until the requisite separation force is achieved. In that case, eccentricity compensation may be applied prior to providing speed adjustment.

The present invention may provide a unique cast steel strip with a composition as described in more detail below in the description of the embodiments described with reference to the drawings.

BRIEF DESCRIPTION OF THE DRAWINGS

Particular embodiments, and possible modifications, will be described in some detail with reference to the accompanying drawings in which.

DETAILED DESCRIPTION OF THE EMBODIMENTS ILLUSTRATED IN THE DRAWINGS

Figure 1:
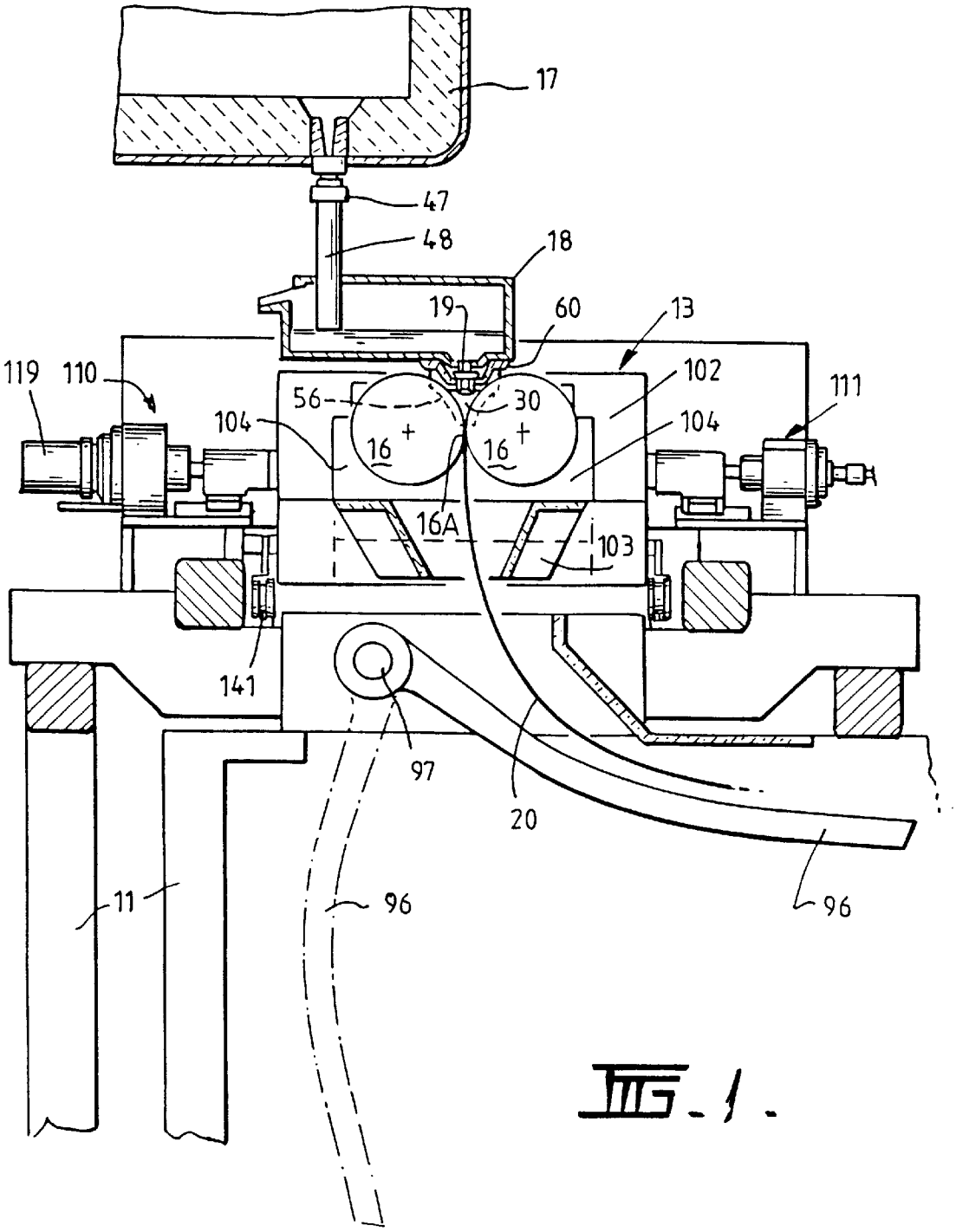
FIG. 1 is a vertical cross section through a strip caster constructed in accordance with the present invention.
Figure 2:
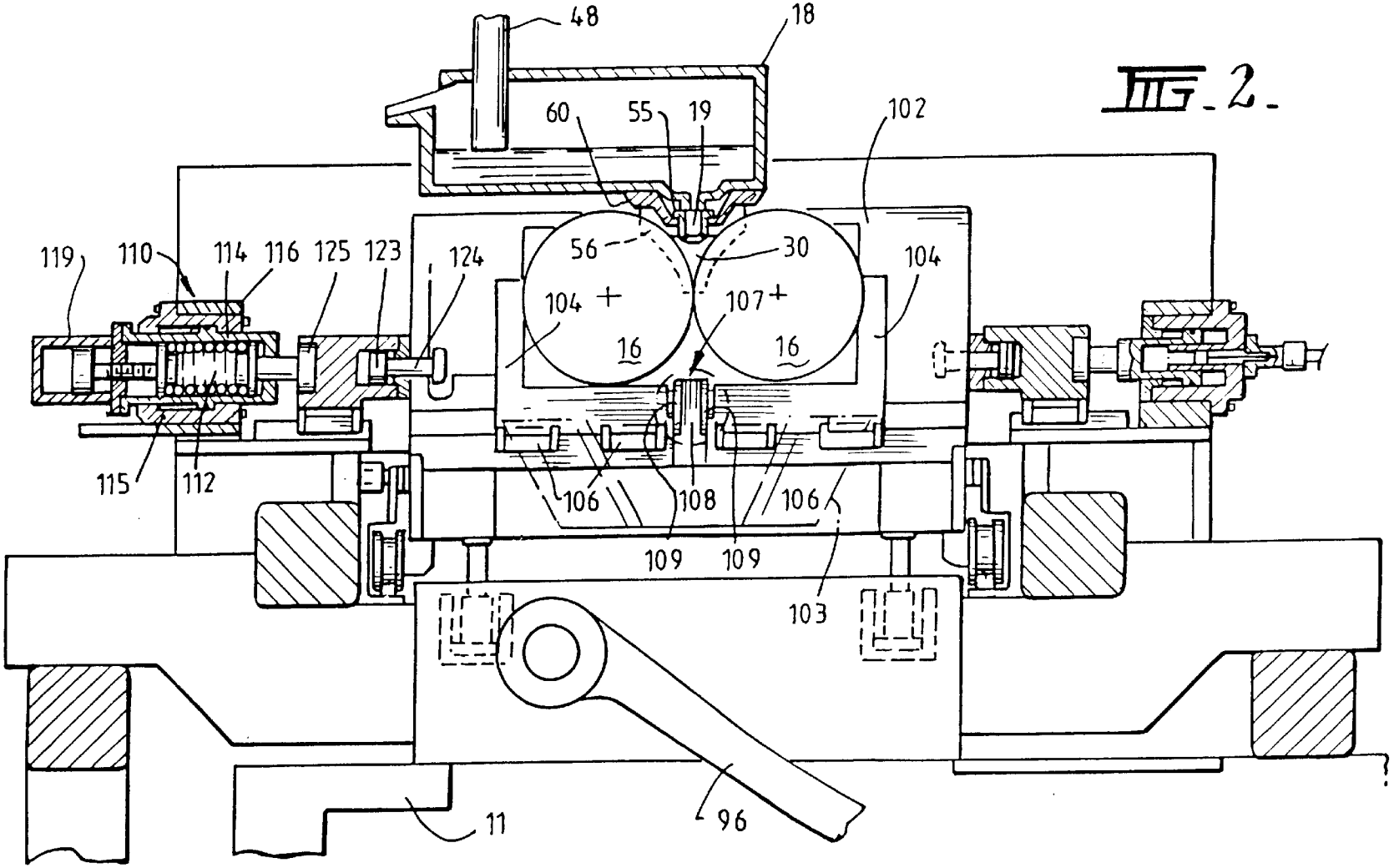
FIG. 2 is an enlargement of part of FIG. 1 illustrating particular components of the caster.
Figure 3:
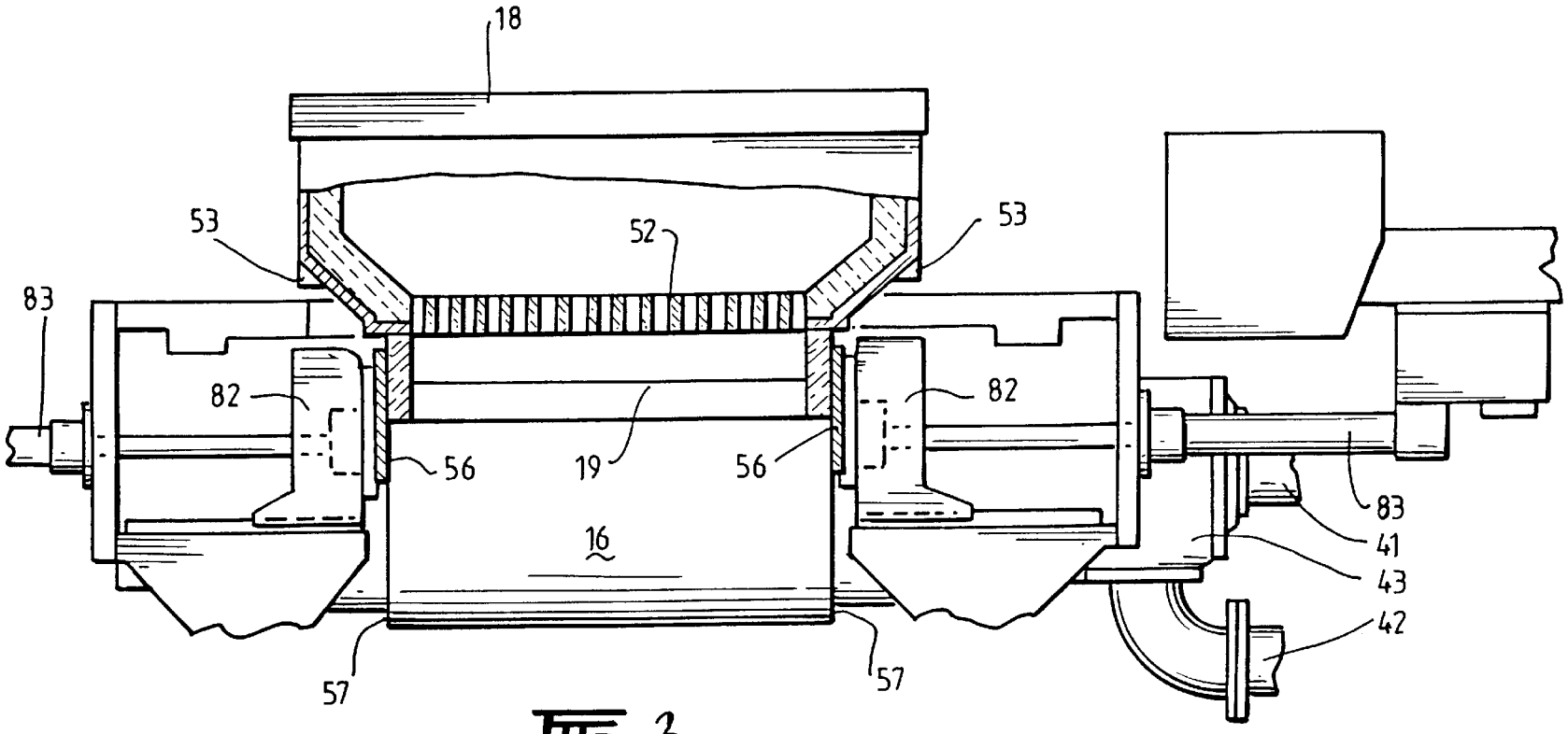
FIG. 3 is a longitudinal cross section through particular parts of the caster.

The illustrated caster comprises a main machine frame 11 which stands up from the factory floor (not shown) and supports a casting roll module in the form of a cassette 13 which can be moved into an operative position in the caster an a unit but can readily be removed when the rolls are to be replaced. Cassette 13 carries a pair of parallel cooled casting rolls 16 having a nip 16A between them, to which molten metal is supplied during a casting operation from a ladle (not shown) via a tundish 17, distributor 18 and delivery nozzle 19 to create a casting pool 30. Casting rolls 16 are water cooled so that solidified shells form onto the moving roll surfaces and are brought together at the nip 16A between them to produce a solidified strip product 20 at the roll outlet. This product may be fed to a standard coiler.

Casting rolls 16 are contra-rotated through drive shafts 41 from an electric motor and transmission mounted on the main machine frame. The drive shaft can be disconnected from the transmission when the cassette is to be removed. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm diameter and up to 2000 mm long in order to produce strip product approximately the width of the rolls.

The ladle is of entirely conventional construction and is supported on a rotating turret whence it can be brought into position over the tundish 17 to fill the tundish. The tundish may be fitted with a sliding gate valve 47 actuable by a servo cylinder to allow molten metal to flow from the tundish 17 through the valve 47 and refractory shroud 48 into the distributor 18.

The distributor 18 is formed as a wide dish made of a refractory material such as magnesium oxide (MgO). One side of the distributor 18 receives molten metal from the tundish 17 and the other side of the distributor 18 is provided with a series of longitudinally spaced metal outlet openings 52. The lower part of the distributor 18 carries mounting brackets 53 for mounting the distributor 18 onto the main canter frame 11 when the cassette 13 is installed in its operative position.

Delivery nozzle 19 is formed as an elongate body made of a refractory material such as alumina graphite. Its lower part in tapered so as to converge inwardly and downwardly so that it can project into the nip 16A between casting rolls 16. Its upper part is formed with outwardly projecting side flanges 55 that locate on a mounting bracket 60 which forms part of the main frame 11.

Nozzle 19 may have a series of horizontally spaced generally vertically extending flow passages to produce a suitably low velocity discharge of molten metal throughout the width of the rolls and to deliver the molten metal into the nip 16A between the rolls without direct impingement on the roll surfaces at which initial solidification occurs. Alternatively, the nozzle 19 may have a single continuous slot outlet to deliver a low velocity curtain of molten metal directly into the nip 16A between the casting rolls 16 and/or it may be immersed in the molten metal pool between the casting rolls 16.

The pool is confined at the ends of the rolls by a pair of side closure plates or dams 56 that are held against stepped ends 57 of the rolls when the roll cassette is in its operative position. Side closure plates 56 are made of a strong refractory material and have scalloped side edges to match the curvature of the stepped ends of the rolls. The side closure plates 56 can be mounted in plate holders 82 which are movable by actuation of a pair of hydraulic cylinder units 83 to bring the side plates into engagement with the stepped ends of the casting rolls to form end closures for the molten pool of metal formed on the casting rolls during a casting operation. Side closure plates 56 are adjacent the ends of the nip 16A, and confine the casting pool formed between the casting rolls 16.

During a casting operation the sliding gate valve 47 is actuated to allow molten metal to pour from the tundish 17 to the distributor 18 and through the metal delivery nozzle 19 whence it flows onto the casting rolls to form the casting pool with confinement of the side closures plates 56. The head end of the strip product 20 is guided by actuation of an apron table 96 to a pinch roll and thence to a coiling station (not shown). Apron table 96 hangs from pivot mountings 97 on the main frame and can be swung toward the pinch roll by actuation of an hydraulic cylinder unit (not shown) after the clean head end has been formed.

The removable roll cassette 13 is constructed so that the casting rolls 16 can be set up and the gap of the nip 16A between them adjusted before the cassette is installed in position in the caster. The gap between the casting rolls at this point in assembly generally should be as small as possible without the casting rolls touching each other. Moreover when the cassette 13 is installed two pairs of roll biasing units 110 and 111 mounted on the main machine frame 11 can be rapidly connected to roll supports on the cassette 13 to provide biasing forces resisting separation of the rolls.

Figure 4:
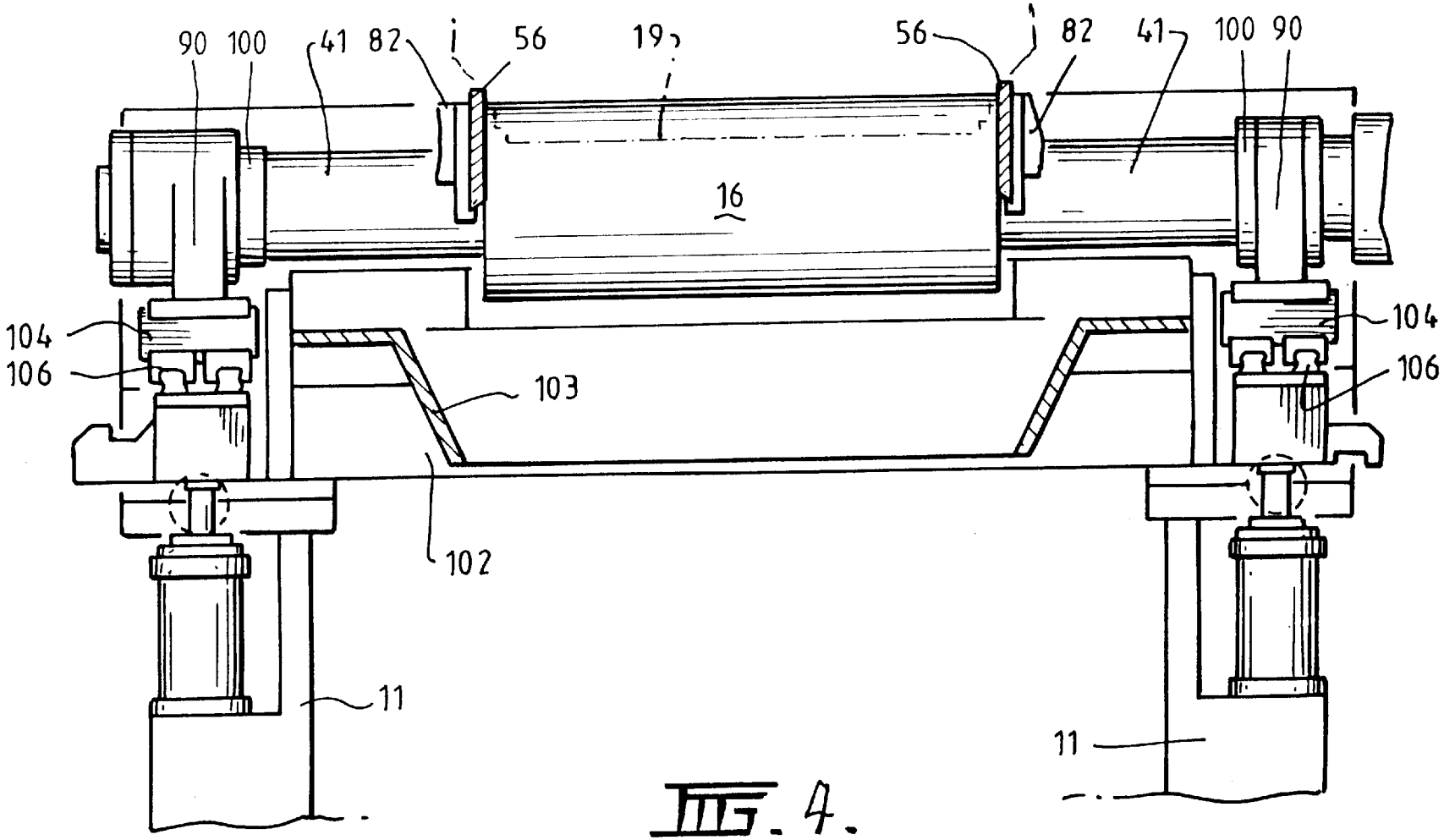
FIG. 4 is an and elevation of the caster.
Figure 5:
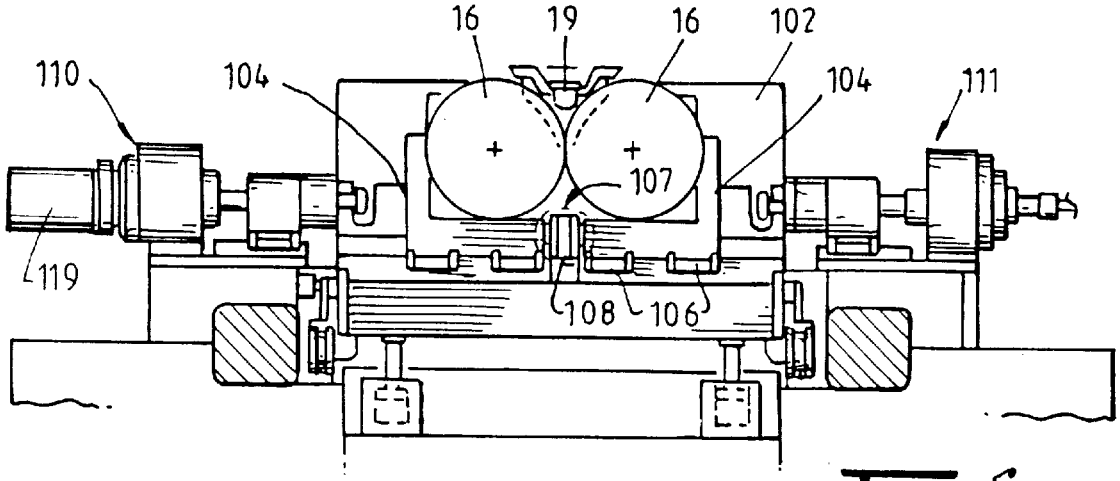
FIGS. 5, 6 and 7 show the caster in varying conditions during casting and during removal of the roll module from the caster.
Figure 6:
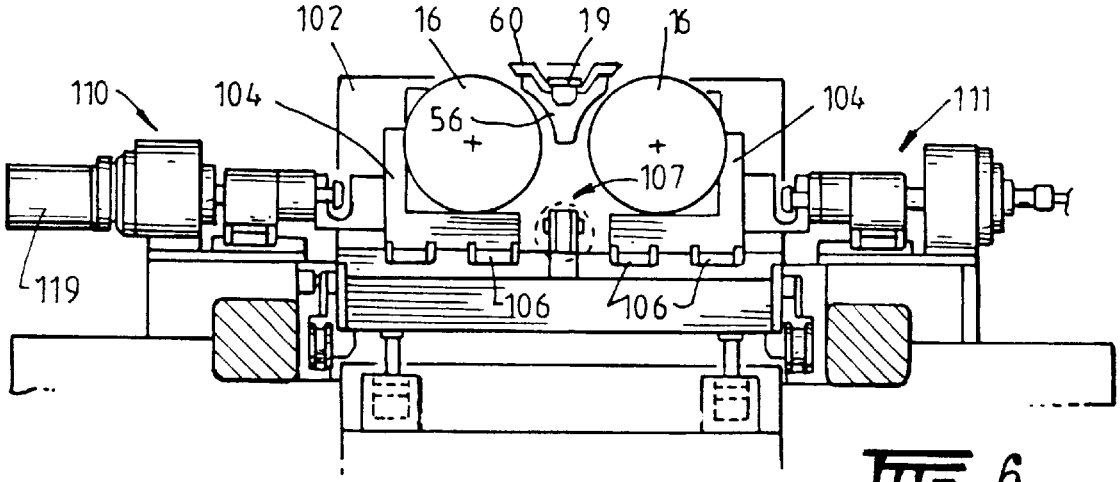
Figure 7:
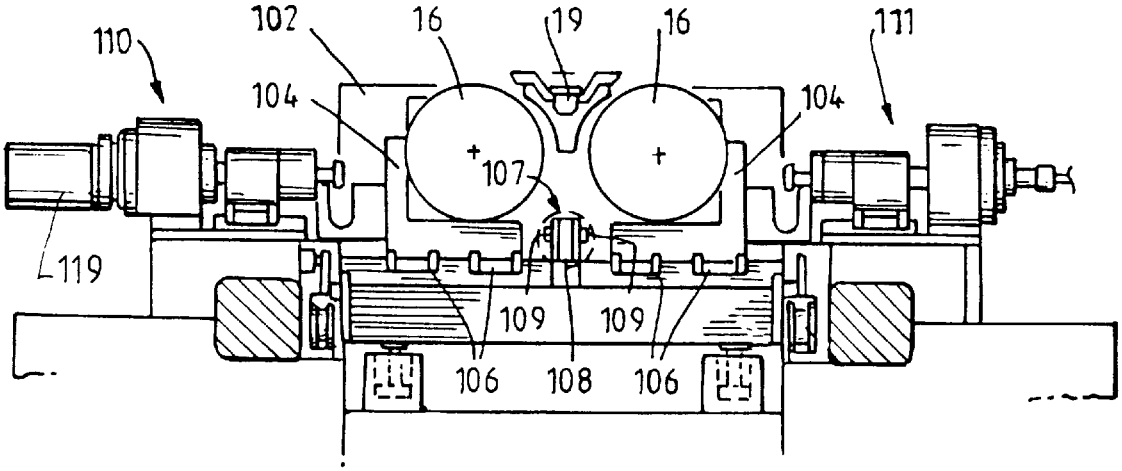

Roll cassette 13 comprises a large frame 102 that carries the casting rolls 16 and upper part 103 of the refractory enclosure for enclosing the cast strip below the nip 16A. Rolls 16 are mounted on roll supports 104 that comprise a pair of roll end support structure 90 (FIG. 4) carrying roll end bearings 100 by which the rolls are mounted for rotation about their longitudinal axis in parallel relationship with one another. The two pairs of roll supports 104 are mounted on the roll cassette frame 102 by means of linear bearings 106 whereby they can slide laterally of the cassette frame to provide for bodily movement of the rolls toward and away from one another thus permitting separation and closing movement between the two parallel casting rolls 16.

Roll cassette frame 102 also carries two adjustable stop means 107 disposed beneath the casting rolls 16 about a central vertical plane between the rolls and located between the two pairs of roll supports 104 so an to serve as stops limiting inward movement of the two roll supports 104 thereby to define the minimum width of the gap at the nip 16A between the rolls 16. As explained below the roll biasing units 110 and 111 are actuable to move the roll supports 104 inwardly against these central adjustable stop means but to permit outward springing movement of one of the casting rolls 16 against preset biasing forces.

Each adjustable stop means 107 is in the form of, for example, a worm or screw driven jack having a body 108 fixed relative to the central vertical plane of the caster and two ends 109 which can be moved on actuation of the driven jack equally in opposite directions to permit expansion and contraction of the jack to adjust the width of the gap at the nip 16A, while maintaining equidistant spacing of the rolls 16 from the central vertical plane of the caster and, also, a substantially constant gap between the casting rolls 16.

The caster is provided with two pairs of roll biasing units 110 and 111 connected one pair to the supports 104 of each roll 16. The roll biasing units 110 at one side of the machine are constructed and operate in accordance with the present invention. These units are fitted with helical biasing springs 112 to provide biasing forces on the respective roll supports 104. The biasing units 111 at the other side of the machine incorporate hydraulic actuators 113. These actuators are operable to hold the respective roll supports 104 of one roll firmly against the central stops and the other roll is free to move laterally against the action of the biasing springs 112 of the units biasing 110 to bias the casting rolls toward each other.

Figure 8:
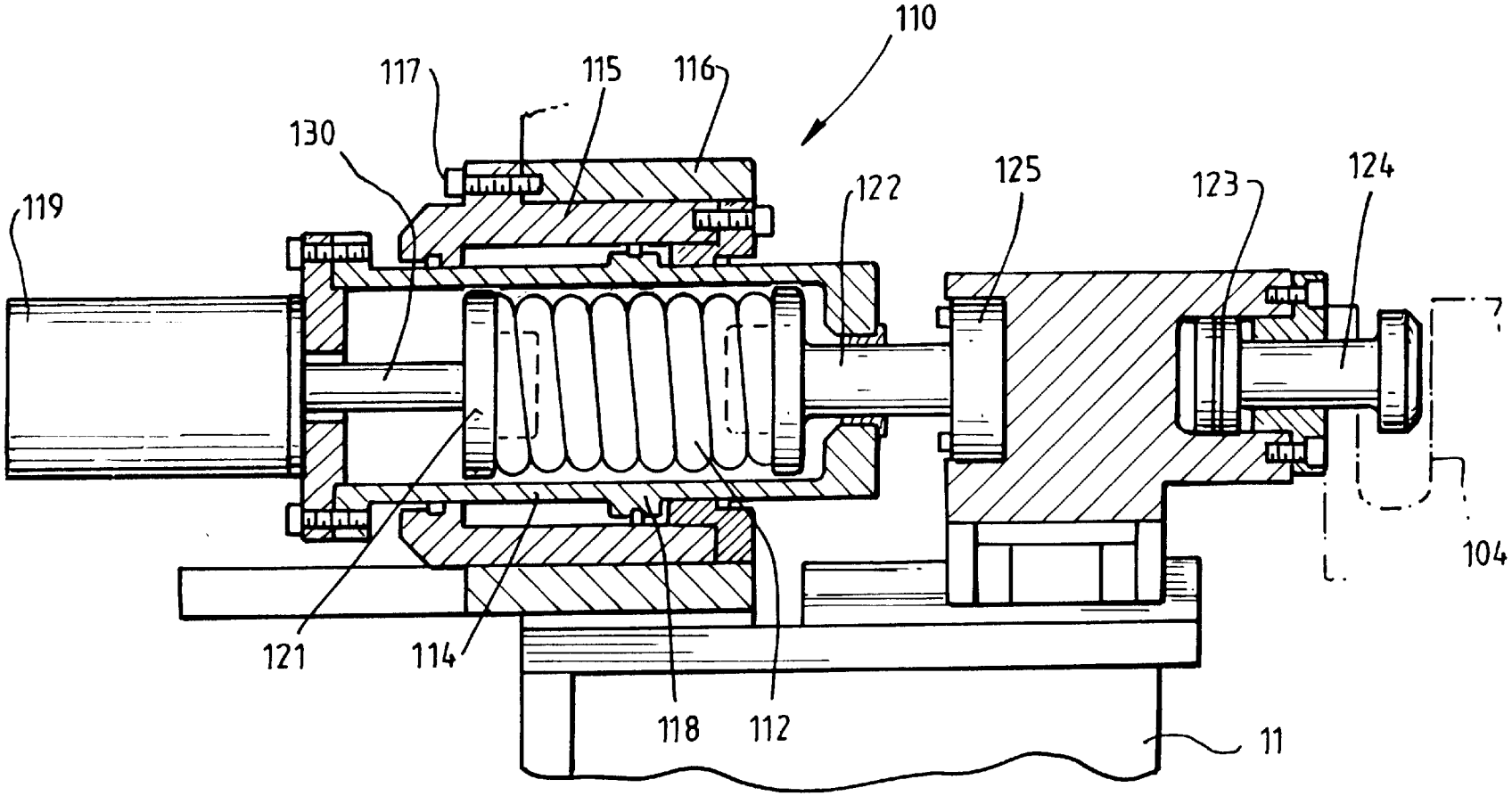
FIG. 8 is a vertical cross-section through a roll biasing unit incorporating a roll biasing spring.

The detailed construction of applicable biasing units 110 is illustrated in FIG. 8. As shown in that figure, the biasing unit comprises a spring barrel housing 114 disposed within an outer housing 115 which is fixed to the main caster frame 116 by fixing bolts 117.

Spring housing 114 is formed with a piston 118 that runs within the outer housing 115. Spring housing 114 can be set alternatively in an extended position as illustrated in FIG. 8 and a retracted position by flow of hydraulic fluid to and from the cylinder 118. The outer end of spring housing 114 carries a pressure fluid operable means in the form of an hydraulic cylinder unit 119 operable to set the position of a spring reaction plunger 121 connected to the piston of unit 119 by a connecting rod 130.

The inner end of the spring 112 acts on a thrust transmission structure 122 which is connected to the respective roll support 104 through a load call 125. The thrust structure is initially pulled into firm engagement with the roll support by a connector 124 that can be extended by operation of a hydraulic cylinder 123 when the biasing unit is to be disconnected.

When biasing unit 110 is connected to its respective roll support 104, with the spring housing 114 set in its extended condition as shown in FIG. 8, the position of the spring housing 114 and cylinder unit 119 is fixed relative to the machine frame and the position of the spring reaction plunger 121 can be set to adjust the effective gap between the spring abutments on the reaction plunger and the thrust transmission structure 122. The compression of the spring 112 can thereby be adjusted to vary the thrusting force applied to the thrust transmission structure 122 and the respective roll support 104. With this arrangement the only relative movement during casting operation is the movement of the roll support 104 and thruster structure 122 as a unit against the biasing spring. Since the biasing unit acts to bias the roll support 104 inwardly against the stop it can be adjusted to preload the roll support with a required spring biasing force before metal actually passes between the casting rolls and that biasing force will be maintained during a subsequent casting operation.

Hydraulic cylinder unit 119 is operated continuously to vary the position of the spring reaction plunger to replicate movements of the thrust transmission structure 122 due to lateral movements of the roll support 104. Any inward or outward movement of roll support 104 will cause a corresponding inward or outward movement of the cylinder of cylinder unit 119 and therefore of spring reaction plunger 121 so as to maintain a constant compression of the compression spring 112. Accordingly, a constant biasing force can be maintained against the casting rolls 16 at each end of the roll regardless of movements of the roll mountings. The continuously operable spring setting means enables very accurate setting of constant biasing forces that can be maintained throughout a casting operation. Moreover, it is possible to use very low stiffness springs, and because the two compensation or control systems for the two roll ends operate completely independently, there need be no cross-talk between the two. Accordingly, this arrangement allows the roll biasing force to be reduced to a very low level in accordance with the present invention. Generally there is a minimum force that is required to balance the hydrostatic pressure of the casting pool (approximately 0.75 kN per side in a 500 mm diameter twin roll caster and 1350 mm roll width) and to overcome the mechanical friction involved in moving the rolls (less than approximately 0.6 kN per side in a 500 mm diameter twin roll caster). This results in a practical low biasing force level, which may be in the range of 0.75 to 2 kN.

Figure 9:
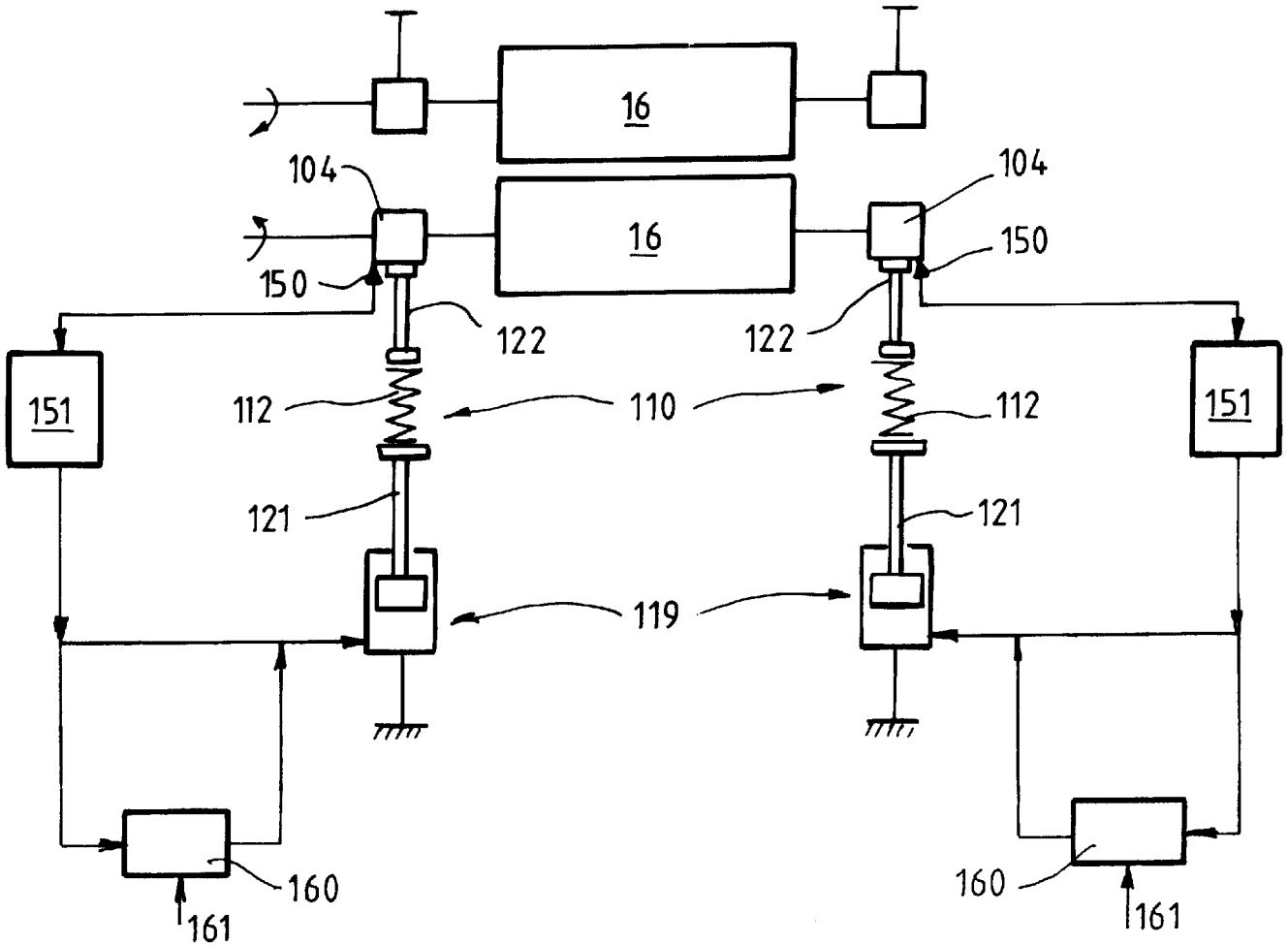
FIG. 9 is a schematic representation of various components of the caster.

As illustrated diagrammatically in FIG. 9, exemplary control means can be comprised of position sensors 150, sensing the position of the thrust transmission structures 122 and connected into a control circuit which controls the operation of the cylinder unit 119 so that the movements of the thrust transmission structures 122 are replicated by the cylinders of units 119. The control circuit may comprise controllers 151 connected to the sensors 150 and to the cylinder units 119 to operate the cylinders 119 so as to replicate movements of the thrust transmission structures 122. Controllers 151 also control operation of the cylinders for initial setting of the roll supports prior to casting and subsequent adjustment to add a similar incremental movement of the cylinders 119 through step controllers 160 to maintain the constant biasing force, and to increase the gap at the nip 16A between the casting rolls 16, so as to produce a gap between the rolls 16 at the nip 16A that is greater than the gap determined by the solidified shell thickness in casting. The step controllers have a set point input at 161.

Figure 11:
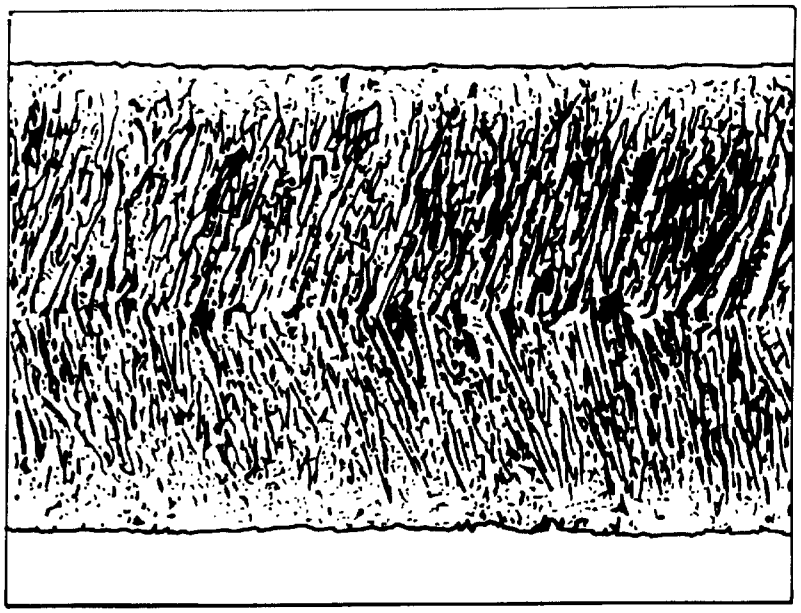
FIG. 11 is a cross-section of a cast steel strip of the prior art illustrated for purposes of comparison.

Typically in accordance with the illustrated embodiments, the system may be operated to maintain a gap at the nip 16A between the casting rolls 16 greater than the gap determined by the solidified shell thickness. In operation of the illustrated system, casting commences with a gap initially determined by the solidified shell thickness. This thickness is illustrated by FIG. 11 where the dendrites of the solidified shells of the strip join in the formed strip. Movement of the roll supports due to remaining roll eccentricities are sensed by the sensors 150 and the control unit learns the pattern of roll movements due to that eccentricity. In order to compensate for the eccentricity induced force fluctuation, the roll chock trajectories are replicated at the spring reaction structures by the position control system and those compensatory movements are continued. The roll gap is then increased by a small amount (such as for example 0 to 50 microns) while the pattern of movements of the spring reaction structure is continued. This even further enhances the already formed substantially constant gap between the casting rolls by further reducing if not eliminating force fluctuation induced by roll eccentricity compensation.

In the control system illustrated in FIG. 9, the step of increasing the gap at the nip 16A between the casting rolls 16 is achieved by moving the roll carriers supporting the spring biased roll and the hydraulically actuated biasing units for the other roll are operated to lock the other roll in a fixed position. The system of the present invention can be used in combination with the eccentricity control system described in our co-pending Australian Patent Application 14901/00, which description is incorporated by reference. In that system, the thickness variations due to roll eccentricity can be very much reduced by imposing a pattern of speed variations in the speed of rotation of the rolls. Compensation in this manner is possible because even small variations vary the time of contact of the solidifying metal shells on the casting rolls within the casting pool, and therefore affect the strip thickness and roll thermal load to facilitate the production of strip of constant thickness. If this form of eccentricity control is adopted, this will reduce the amplitude of the initial roll support fluctuations and the need for compensatory movements within the minimal force/constant gap system of the present invention. The present invention also provides enhanced productivity.

Figure 10:
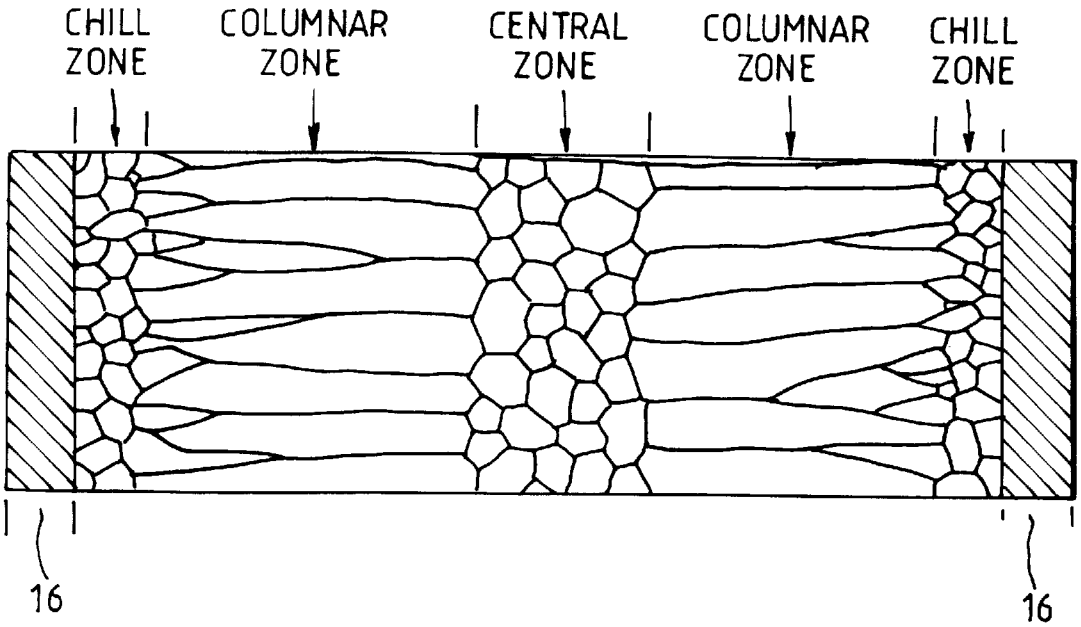
FIG. 10 is a cross-section of a cast steel strip made as described by the present invention.

Referring to FIG. 10, unique steel product made by the presently described method is illustrated. The unique cast steel strip made by the following steps of assembling a pair of cooled casting rolls having a nip between them and confining closures adjacent the ends of the nip, introducing molten metal between said pair of casting rolls to form a casting pool between the rolls with the closures confining the pool adjacent the ends of the nip, rotating the rolls such that shells of metal solidify from the casting pool onto the casting rolls and are brought close together at the nip to produce a solidified strip delivered downwardly from the nip, biasing at least one of the pair of casting rolls toward the other roll of the pair under a biasing force and maintaining a substantially constant gap between the rolls at the nip sufficient to provide separation between the solidified shells at the nip, preferably with the biasing force creating a roll separation force less than 0.45 kN, and passing molten metal between the solidified shells through the nip where at least a portion of said molten metal is solidified in the strip below the nip. The columnar dendrite structure of steel formed in the solidified shells onto the casting rolls 16 do not come together. This is illustrated by comparison in FIG. 11, where the structure of steel strip made by the previously described strip casting process is illustrated. There the columnar dendrite structure of the solidified shell join in the formed strip as the solidified shells come together. However, in steel strip made in accordance with the present invention, there is a central zone within the steel strip between the solidified shells that solidifies after strip passes through the gap between the casting rolls 16 at the nip 16A.

What is claimed is:

1. A method of casting metal strip comprising:

assembling a pair of cooled casting rolls having a nip between them and confining closures adjacent the ends of the nip, introducing molten metal between said pair of casting rolls to form a casting pool between the rolls with the closures confining the pool adjacent the ends of the nip, rotating the rolls such that shells of metal solidify from the casting pool to form onto the casting rolls and are brought close together at the nip to produce a solidified strip delivered downwardly from the nip, biasing at least one of the pair of casting rolls toward the other roll of the pair under a biasing force between substantially the same and slightly more than that required to balance the hydrostatic pressure of the casting pool and the mechanical friction involved in moving the casting rolls in biasing them toward each other such that a substantially constant gap is maintained between the rolls at the nip sufficient to provide separation between the solidified shells at the nip, and passing molten metal between the solidified shells through the nip so that at least a portion of said molten metal may be solidified in the strip below the nip.

2. A method as claimed in claim 1, wherein the molten metal is a steel.

3. A method as claimed in claim 2, wherein the casting rolls are rotated to produce solidified steel strip at a casting speed of at least 30 meters/minute.

4. A method as claimed in claim 3, wherein the casting speed is at least 60 meters/minute.

5. A method as claimed in claim 1 wherein said biasing force produces a roll separation force in the range 0 to 1.25 kN.

6. A method as claimed in clam 5 wherein said biasing force produces a roll separation force not more than 0.45 kN.

7. A method as claimed in claim 1 wherein the biasing is done by spring biasing.

8. A method as claimed in claim 1 where the biasing is done by servo-controlled biasing.

9. A method of casting metal strip comprising:

assembling a pair of cooled casting rolls having a nip between tern and confining closures adjacent the ends of the nip, introducing molten metal between said pair of casting rolls to form a casting pool between the rolls with the closures confining the pool adjacent the ends of the nip, rotating the rolls such that shells of metal solidify from the casting pool to form onto the casting rolls and are brought close together at the nip to produce a solidified strip delivered downwardly from the nip, biasing at least one of the pair of casting rolls toward to other roll of to pair under a substantially constant biasing force between substantially the same and slightly more than that required to balance the hydrostatic pressure of the casting pool and the mechanical friction involved in moving to casting rolls in biasing them toward each other such that a substantially constant gap is maintained between the rolls at the nip sufficient to provide separation between the solidified shells at the nip, wherein the biasing force is a force creating a roll separation force not greater than 0.35 kN, and passing molten metal between the solidified shells through the nip where at least a portion of said molten metal may be solidified in the strip below the nip.

10. A method as claimed in claim 9 comprising the additional steps of mounting at least one of the casting rolls on moveable roll supports to provide movement of the casting rolls toward each other, and applying said biasing force to the roll supports by a pair of biasing units.

11. A method as claimed in claim 10 comprising the additional steps of including in the biasing unit a trust generator acting between a thrust transmission structure connected to the roll supports, and including a thrust reaction structure generating a thrust on the roll support dependent on the spacing between the trust reaction structure and the thrust transmission structure.

12. A method as claimed in claim 11 wherein the thrust generator includes a compression spring or pressure fluid cylinder unit.

13. A method as claimed in claim 11 including the additional steps of:

initiating casing of the strip with a gap between the rolls determined by the solidified shells being allowed to meet at the nip, allowing said casting roll to move relative to each other to follow strip thickness variation due to casting roll eccentricities, applying the same pattern of movement to the trust reaction structures of the biasing units to maintain said biasing force substantially constant with rotation of the casting rolls, increasing the gap between the casting rolls such that molten metal passes through the nip between the solidified shells in the strip, and continuing casting of the solidified strip with the increased gap held substantially constant while continuing to apply said pattern of movement to the thrust reaction structures to maintain a substantially constant roll biasing force.

14. A method as claimed in claim 13 wherein the increase in said gap is in the range of 0 to 50 microns.

15. A method as claimed in claim 13 wherein the increase in said gap is done by relative movement of the casting roll.

* * * * *